US006716048B2

(12) United States Patent
Collin et al.

(10) Patent No.: US 6,716,048 B2
(45) Date of Patent: Apr. 6, 2004

(54) COUPLING MECHANISM FOR ELECTRICAL CONNECTORS

(75) Inventors: Edwin Collin, Southington, CT (US); William D. Porzio, Woodbury, CT (US); Allen J. Bernardini, Southbury, CT (US); Paul Kozubal, Bristol, CT (US)

(73) Assignee: ITT Manufacturing Enterprises, Inc., White Plains, NY (US)

( * ) Notice: Subject to any disclaimer, the term of this patent is extended or adjusted under 35 U.S.C. 154(b) by 0 days.

(21) Appl. No.: 10/096,114

(22) Filed: Mar. 13, 2002

(65) Prior Publication Data

US 2002/0132509 A1 Sep. 19, 2002

Related U.S. Application Data

(60) Provisional application No. 60/275,468, filed on Mar. 14, 2001.

(51) Int. Cl.[7] ..... H01R 4/54

(52) U.S. Cl. ..... 439/317; 439/348

(58) Field of Search ..... 439/348, 317, 439/314, 318, 319, 312; 285/315, 316, 330

(56) References Cited

U.S. PATENT DOCUMENTS 2,892,991 A * 6/1959 Beebee et al. ..... 439/319
4,265,503 A 5/1981 Baur
6,062,891 A 5/2000 Villiers

FOREIGN PATENT DOCUMENTS

FR 1354923 2/1964
FR 3690569 10/1993

* cited by examiner

*Primary Examiner*—Tulsidas Patel
*Assistant Examiner*—Phuong K T Dinh
(74) *Attorney, Agent, or Firm*—Lowe Hauptman Gilman & Berner, LLP

(57) ABSTRACT

The present invention is directed to a structure for coupling a plug connector to a receptacle connector by simply pushing the plug connector to lock into place on a receptacle connector and pull the coupling nut to release. Although the action of the push to lock and pull to release is not unique to the connector industry, the present invention is unique in that the plug and receptacle connectors are locked from relative circumferential motion or axial motion to each other when coupled. The connector in a locked mated condition prevents relative motion during high shock and vibration applications. This is achieved by making surface contact between the plug connector and the receptacle connector with a considerable force. Advantageously, the locking condition of the mated connector protects the electrical contacts from excessive wear created when relative motion exists between the plug connector and the receptacle connector, thus preventing loss of continuity, excessive heating and even combustion due to excessive heating.

6 Claims, 9 Drawing Sheets

COUPLING MECHANISM FOR ELECTRICAL CONNECTORS

RELATED APPLICATION

The present application claims priority from U.S. Provisional Application Serial No. 60/275,468 filed Mar. 14, 2001 entitled "Push-Pull Quick Connect Connector System", the disclosure of which is incorporated by reference herein in its entirety.

FIELD OF THE INVENTION

The present invention relates generally to the field of electrical connectors, and more particularly, to a coupling mechanism for an electrical connector. Even more particularly, the present invention relates to a push-pull quick connector system which prevents axial motion of the plug connector and receptacle connector.

BACKGROUND OF THE INVENTION

Electrical connector systems including a plug connector and a receptacle connector are known. Coupling mechanisms for a plug and a receptacle connector normally use a coupling nut with either a thread or a bayonet design. The action of threading or operating the bayonet involves pushing forward as well as rotation of the coupling nut to lock the plug and receptacle connectors to form a rigid union between the plug connector and the receptacle connector. Disadvantageously, this action adds time to couple each connector in a multiple connector apparatus when repair is needed. Further, a plug connector and receptacle connector is needed in which relative motion of the contacts is prevented.

SUMMARY OF THE INVENTION

It is, therefore, an object of the present invention to provide an electrical connector in which the plug and receptacle connectors are locked from relative circumferential and/or axial movement when coupled.

Another object of the present invention is to provide an electrical connector which can be locked together by movement of the plug and receptacle connectors in an axial direction.

These and other objects of the present invention are achieved by an electrical connector including a receptacle assembly which includes a receptacle connector and has a plurality of movable balls retained in a wall thereof. A plug assembly includes a plug shell and has a shoulder and an annular groove. A coupling ring has a shoulder and a thrust surface. A spring is associated with the coupling ring and biases the coupling ring shoulder into the plug shell shoulder. The receptacle assembly and the plug assembly have an unmated condition and a locked mated condition. The receptacle assembly and the plug assembly are brought into the locked mated condition when the receptacle assembly and the plug assembly are pushed together and the plurality of balls are thrust radially inwardly into the annular groove and retained there by the spring bias and thrust surface.

The foregoing and other objects of the present invention are achieved by an electrical connector including a receptacle assembly. The receptacle assembly includes a receptacle connector and has a plurality of studs extending radially outwardly therefrom and a plurality of contacts. A plug assembly has a plurality of contacts and includes a plug body having one of a keyway and a key. A coupling nut includes a plurality of studs extending radially inwardly and has one of a keyway and a key. A spring biases the coupling nut in one direction. A rotatable sleeve is retained in the plug and includes coupling nut ramps and receptacle ramps. The receptacle assembly and the plug assembly have an unmated condition and a locked mated condition. The receptacle assembly and the plug assembly are brought into the locked mated condition when the receptacle assembly and the plug assembly are pushed together and the studs of the receptacle assembly and the coupling nut engage the rotatable sleeve and cause the sleeve to rotate thereby locking the receptacle assembly and the plug assembly.

The foregoing and other objects of the present invention are achieved by an electrical connector including a receptacle assembly. The receptacle assembly includes a receptacle connector and has a plurality of studs extending radially outwardly therefrom and a plurality of contacts. A plug assembly has a plurality of contacts and includes a plug body having one keyway and a key. A coupling nut includes a plurality of studs extending radially inwardly and has one of a keyway and a key such that the coupling nut is prevented from rotation relative to the plug body. A spring biases the coupling nut in one direction such that the spring biases coupling nut against the coupling nut studs. A rotatable sleeve is retained in the plug and includes coupling nut ramps and receptacle ramps. The receptacle assembly and the plug assembly have an unmated condition and a locked mated condition. When the receptacle assembly studs are aligned with the receptacle ramps in the unmated condition and the receptacle assembly and the plug assembly are pushed together, the rotatable sleeve rotates thereby aligning the coupling nut studs and the coupling nut ramps. Further pushing of the receptacle assembly and the plug assembly cause further rotation of the rotatable sleeve and axial movement of the sleeve into a locked mated condition.

The present invention provides a structure for coupling a plug connector to a receptacle connector by simply pushing the plug connector to lock into place on a receptacle connector and pull the coupling nut to release. Although the action of the push to lock and pull to release is not unique to the connector industry, the present invention is unique in that the plug and receptacle connectors are locked from relative circumferential motion or axial motion to each other when coupled. The connector in a locked mated condition prevents relative motion during high shock and vibration applications. This is achieved by making surface contact between the plug connector and the receptacle connector with a considerable force. Advantageously, the locking condition of the mated connector protects the electrical contacts from excessive wear created when relative motion exists between the plug connector and the receptacle connector, thus preventing loss of continuity, excessive heating and even combustion due to excessive heating.

The present invention saves time in connecting and disconnecting the connectors in that a single quick push to lock and pull to release action is required. The lock feature is unique in that the spring force required to lock the connector halves also pulls the plug and receptacle connectors together near the lock position. The lock feature also exerts a high thrust force axially in the mating direction to eliminate the relative motion between the plug and receptacle connector. In a second embodiment, this advantage is achieved with the use of bias angles to create a mechanical advantage.

The present invention is particularly well suited for low electrical current applications as well as fiber optic applications.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
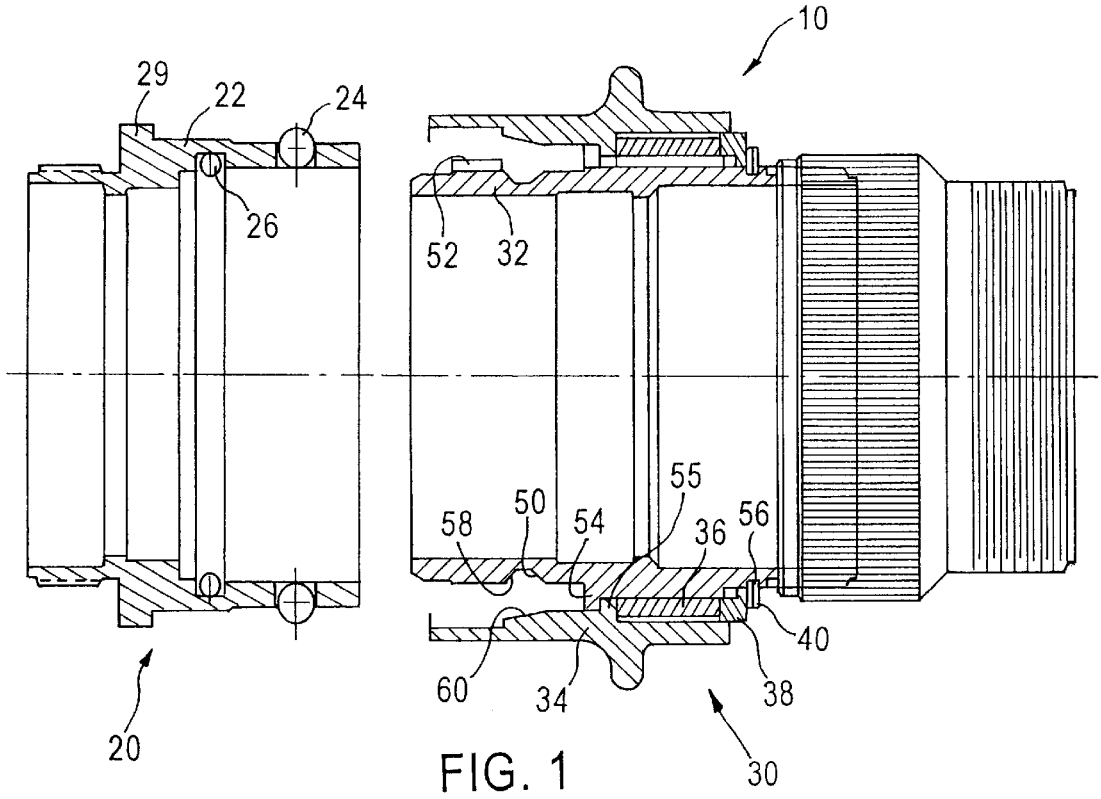
FIG. 1 is an exploded cross-sectional view of a first embodiment of the plug and receptacle connector according to the present invention.

An electrical connector, generally indicated at 10, according to a first embodiment of the invention is illustrated in FIG. 1. For convenience and purposes of illustration, the electrical contacts used in the first embodiment of the electrical connector have been omitted for clarity. It should also be understood in that present invention has been illustrated in a horizontal orientation and that terms such as "left" and "right" are to be construed in the relative sense and it should be understood that the present invention is usable in any orientation. The electrical connector 10 includes a receptacle 20 and a plug 30. The receptacle 20 includes a receptacle body 22, a plurality of balls 24 and an o-ring 26. Generally, four balls 24 will be used in the invention, although it is to be understood that any number of balls can be used. The balls are retained in through holes in the receptacle body 22 using a peening operation which partially deforms the material adjacent to the ball so that each of the balls are free to move in a direction perpendicular to the longitudinal axis of the receptacle body 22. Besides peening, the balls can be retained using other methods. In other words, the balls 24 are free to move in and out as will be described below. The balls 24 are equally spaced circumferentially.

Figure 1A:
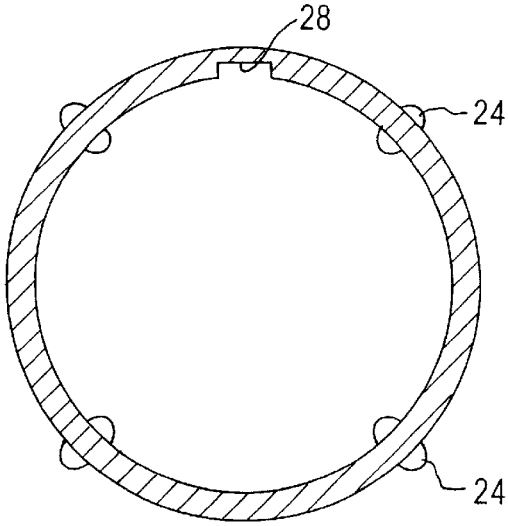
FIG. 1A is a right side elevational view of a keyway in the receptacle body.

As depicted in FIG. 1, the balls 24 extend radially inwardly and radially outwardly beyond the respective inner and outer surfaces of the receptacle body 22. As depicted in FIG. 1A, the receptacle body 22 also includes an alignment slot or keyway 28 positioned circumferentially between the equally spaced balls 24 to receive a rib or key 52 in the plug shell 32 to maintain relative circumferential alignment between the receptacle 20 and the plug 30. The receptacle body 22 has a flange 29.

The plug assembly 30 includes a plug shell 32, a coupling nut 34, a spring 36, a spring retainer 38, and a retaining ring 40. The plug shell 32 includes a radially outwardly facing annular groove 50 for receiving and retaining the balls as discussed below. The plug shell 32 also has an elongated longitudinally extending rib or key 52 on an outer surface thereof to be received in alignment slot or keyway 28 to maintain circumferential alignment between the plug 30 and the receptacle 20. The plug shell 32 has an annular outwardly extending shoulder 54 at a central portion thereof and an annular groove 56 for receiving the retaining ring 40 at a rear end thereof.

The coupling nut 34 is generally cylindrical and includes an angled surface 60 which serves as a coupling nut lock surface. The spring 36 is positioned between a shoulder 55 of the coupling nut 34 and the spring retainer 38 is retained by the retaining ring 40.

Figure 2:
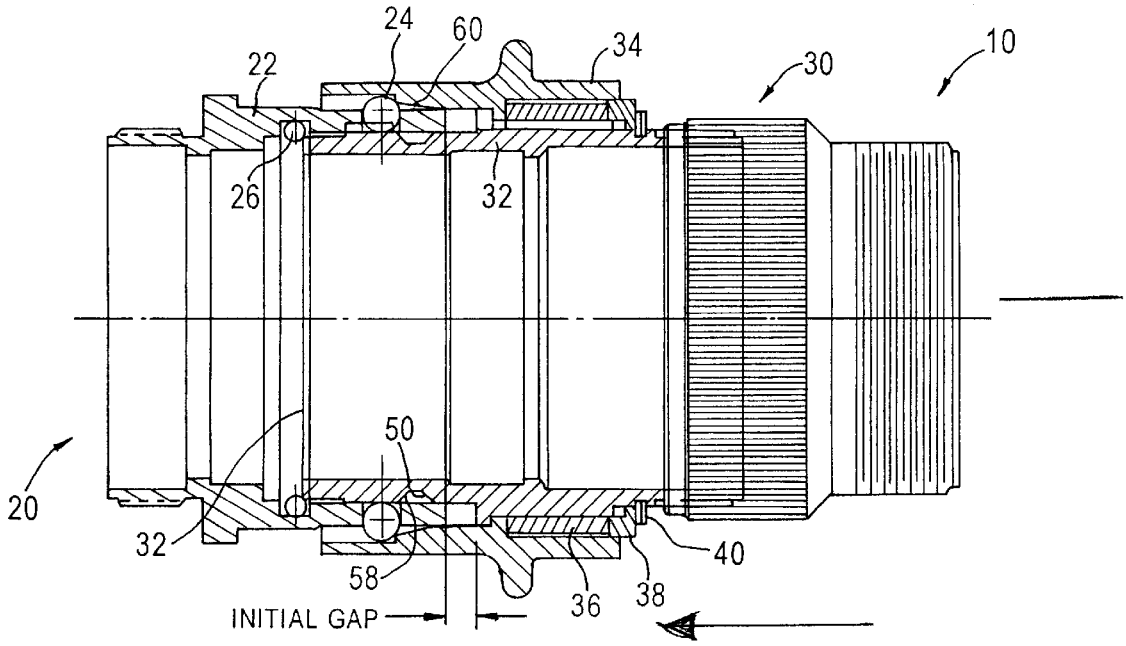
FIG. 2 is a view similar to FIG. 1 where the plug is being pushed in the direction indicated where there is an initial gap between a front edge of the receptacle and a shoulder in the plug shell.

As depicted in FIGS. 1–4, the coupling nut 34 is forced in a direction towards the receptacle 20 by the spring 36. The spring force can be approximately 20–30 pounds. To couple the receptacle 20 and the plug connector 30, the direction of movement of the plug connector 30 is axially toward the receptacle 20. The motion of pushing or engaging the plug connector 30 into the receptacle 20 will, at one point, make contact with the balls 24 of the receptacle 20 by the coupling nut 34. At this point, as depicted in FIG. 2, the spring 36 is pushed rearwardly by the coupling nut 34. The balls 24 of the receptacle 20 will glide along the surface of the outside diameter of the plug shell 32 approaching the groove 50, which defines the thrust surface 58 of the plug shell 32. When the plug connector 30 is moved further toward the receptacle 20, the balls 24 of the receptacle 20 will begin to fall into this groove 50 by virtue of the force angle exerted on the balls 24 by the thrust surface 58. The coupling nut 34 is biased in this direction and the thrust surface 60 biases the balls 24 in a radially inward direction. The thrust surface of the coupling nut 34 has a shallow bias angle that creates a mechanical advantage that will then push the ball 24*s* further radially inwardly. The plug shell thrust surface 60 also has a bias angle in such a direction which creates a mechanical advantage to thrust the coupling nut 34 toward the receptacle 20. The motion stops when flange 29 of the receptacle body 22 makes contact with the shoulder 54 of the plug shell 32, eliminating the gap shown in FIG. 2 between the front edge of the receptacle 20 and the shoulder 54 of the plug shell 32

Figure 3:
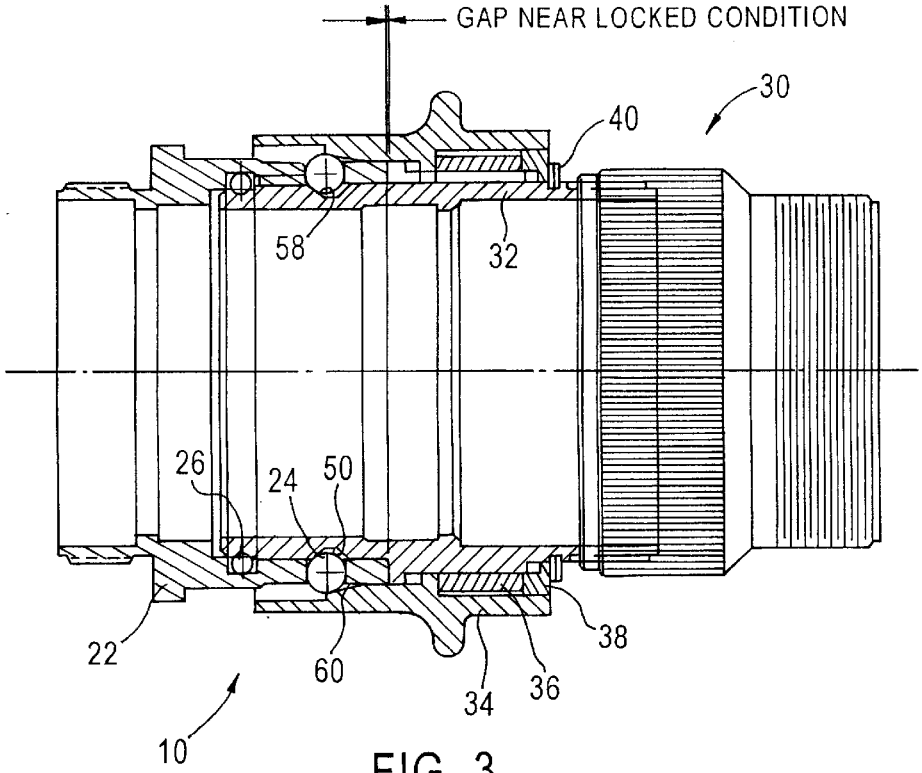
FIG. 3 is a view where the balls have begun to engage a groove in the plug and the gap is near a locked mated condition.

(shown in FIG. 3). The spring force of the coupling nut 34, the coupling nut lock surface 60, the receptacle balls 24 and the plug shell thrust surface 58 create a bias force axially to force the receptacle connector 20 and the plug shell 32 connector together and lock them together. The mechanical advantage is so great that when an opposing axial force is placed on the plug connector 30 against the receptacle connector 20, their positions are maintained.

Removal of the plug connector from the coupled position is accomplished by pulling the coupling nut 34 and only the coupling nut 34 axially away from the receptacle connector 20. This frees the area radially outward from the receptacle ball 24, eliminating restriction of movement of the balls 24. The plug shell thrust surface 60 will allow the balls 24 to move radially outwardly and allow the plug connector 30 to move axially away to disconnect. Release of the coupling nut 34 by virtue of the spring force allows the plug connector 30 and coupling nut 34 to return to its original condition to mate with the receptacle with balls 24.

In FIG. 2, the plug connector 30 moves in the receptacle connector 20 at a position where the balls 24 are in contact with the plug shell 32 outside diameter. The coupling nut 34 is in contact with the receptacle balls 24 and the balls 24 are forcing the coupling nut 34 to move axially relative to the plug shell 32 but stationary with respect to the receptacle connector 20.

In FIG. 3, the plug connector 30 is at a position where the receptacle balls 24 have approached the plug shell groove 58. At this time, the coupling nut lock surface 60 is interacting on the receptacle balls 24 with a bias angle at a mechanical advantage towards the plug shell groove 50. The resultant contact to the plug shell 32 of the balls 24 is on the plug shell thrust surface 58. This surface is also biased but in a direction axially, creating a mechanical advantage axially to lock the plug shell 32 to the receptacle 20.

Figure 4:
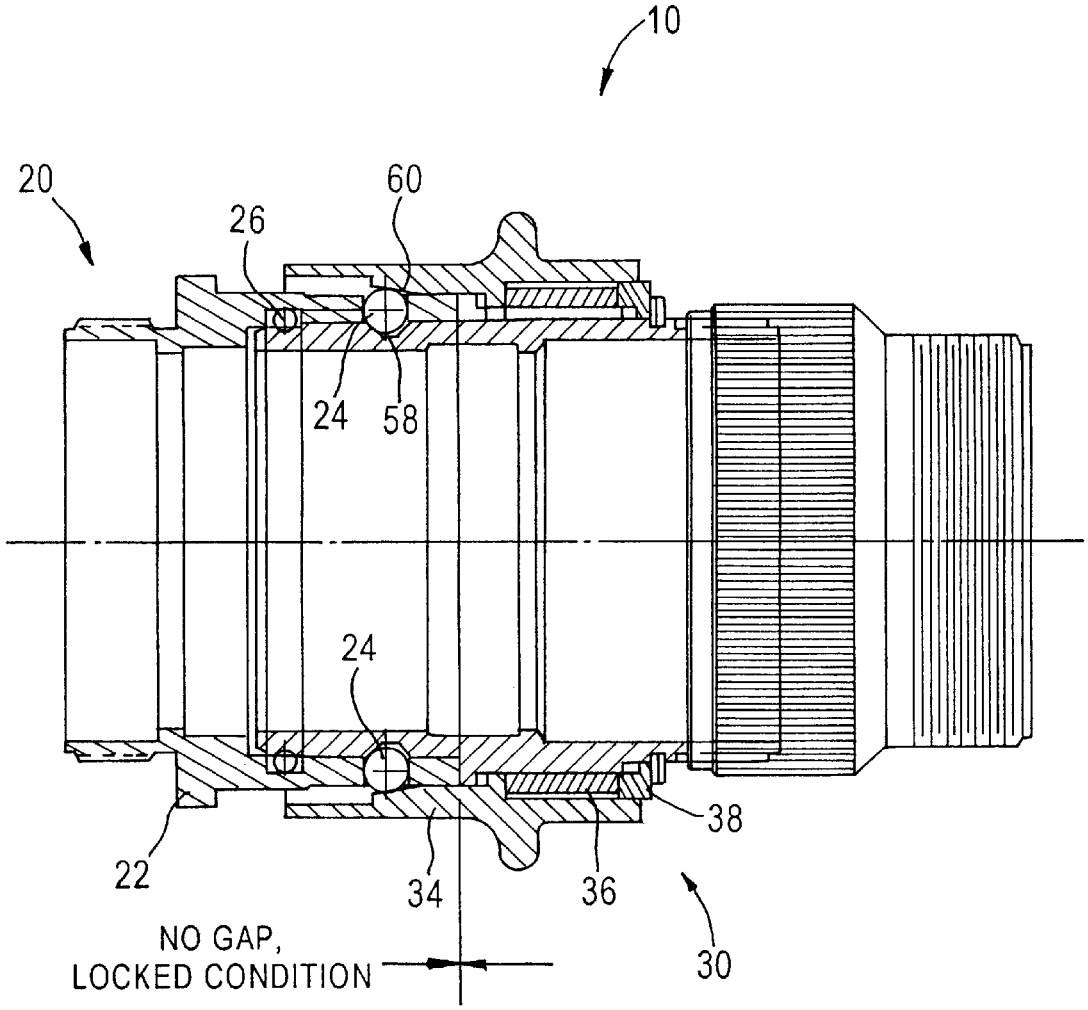
FIG. 4 is a view of the connector in a locked mated condition where the plug and receptacle are mated and there is metal-to-metal bottoming (no gap)

In FIG. 4, the plug connector 30 and the receptacle connector 20 are depicted in the mated locked condition.

A second embodiment of the present invention is depicted in FIGS. 5–12. It should be understood that although terms such as rearwardly, forwardly, right and left are used herein, these terms are only used in the relative sense.

The electrical connector 100 includes a plug assembly 102 and a receptacle assembly 110. A plurality of contacts 92, 94, 96, 98 are depicted and these contacts can also be used for the electrical connector according to the first embodiment. Female contacts 92, 94 and male contacts 96, 98 mate respectively in a known manner. Contacts 92–98 must be aligned before engaging the plug assembly 102 and the receptacle assembly 110. Advantageously, in both the first and second embodiments, axial and circumferential movement of the contacts is prevented by the push-pull connect system according to the present invention.

As depicted in FIGS. 5–12, the plug assembly 102 includes a coupling nut 120, a compression spring 122, a spring retainer 124, a second retaining ring 126, first retaining ring 128, a sleeve 130, and a plug shell 132. Advantageously, by using a rotating sleeve having two cam type ramps, a bayonet style coupling can be used to mate and lock axial contacts.

Figure 5:
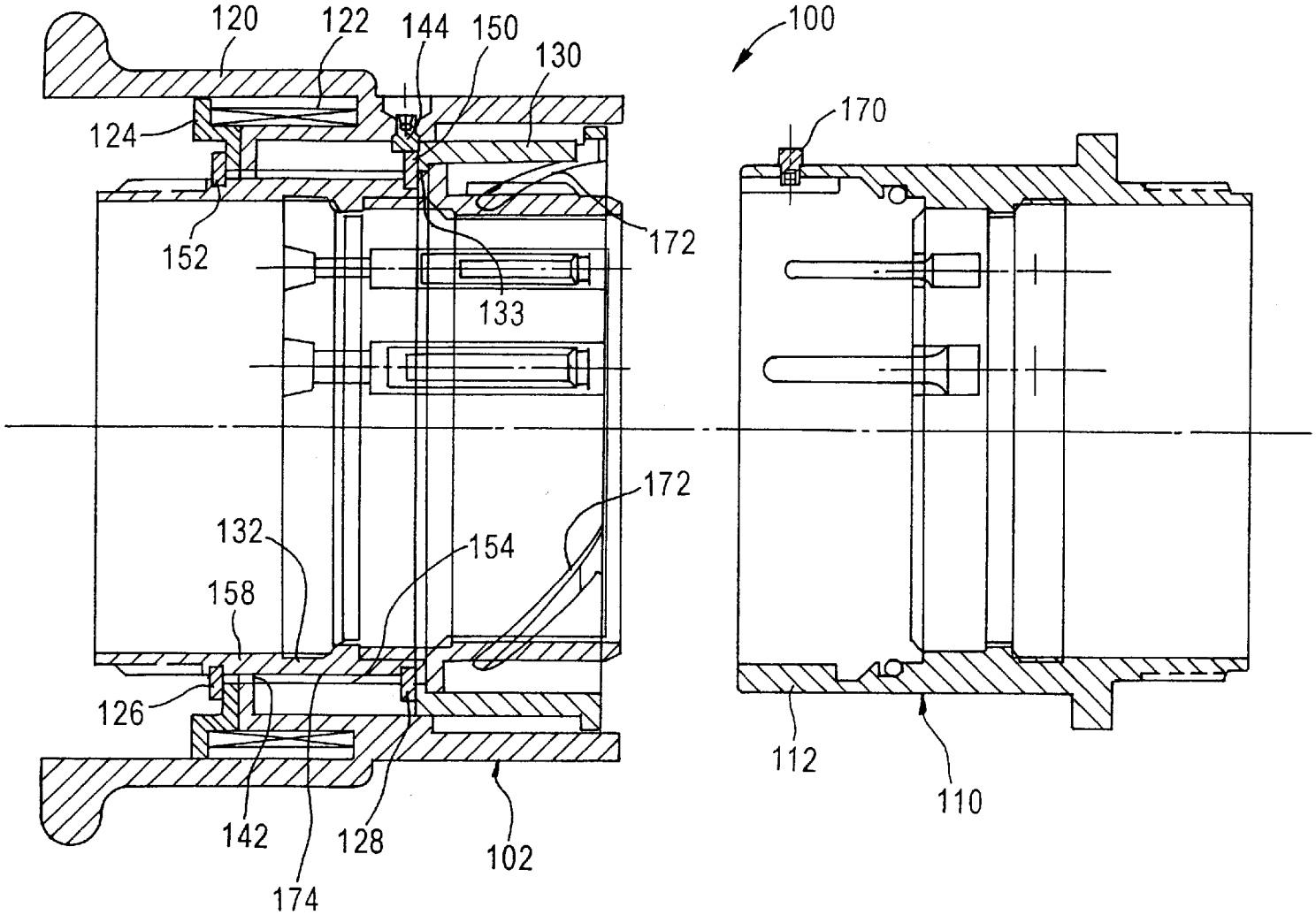
FIG. 5 is a side cross-sectional view of the receptacle and plug connectors in an unmated condition according to a second embodiment of the present invention.
Figure 6:
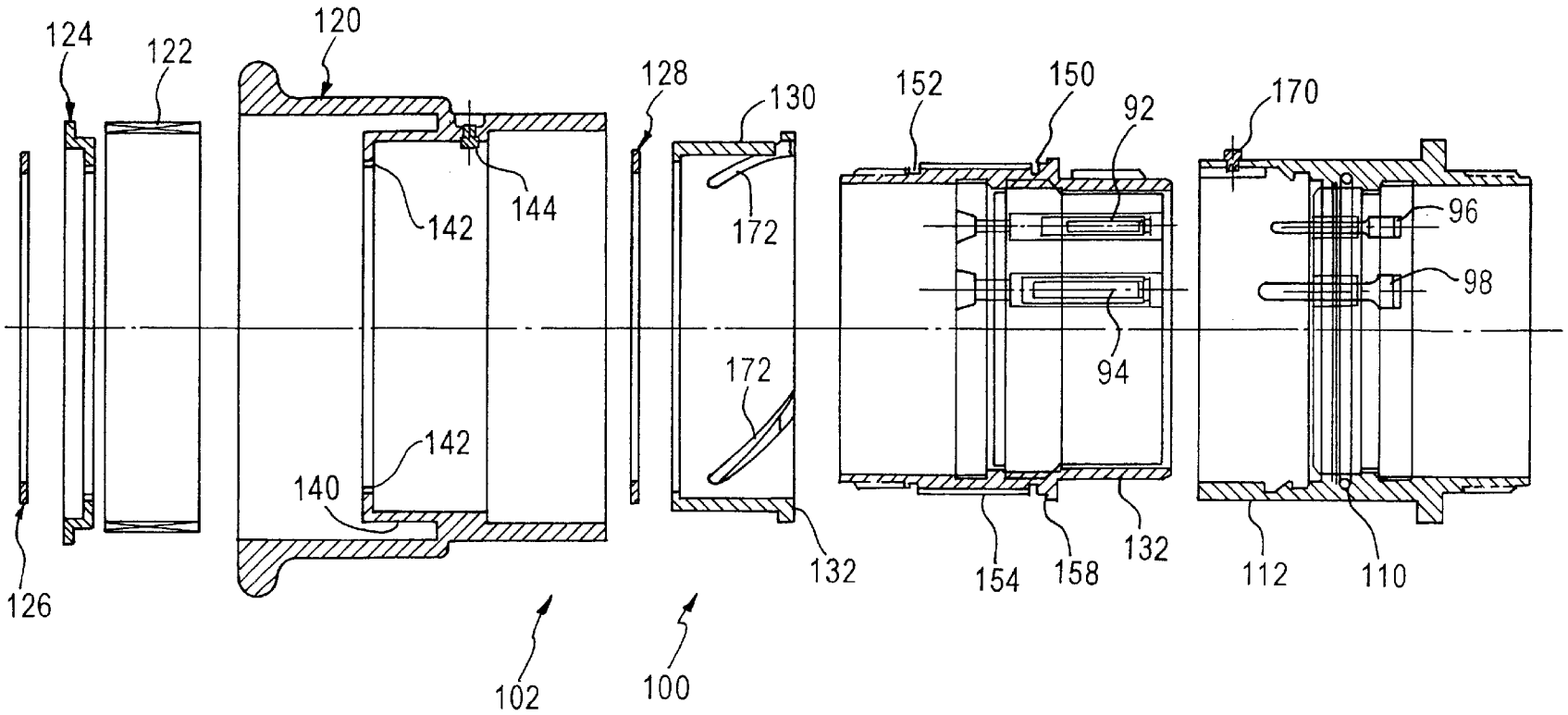
FIG. 6 is a completely exploded cross-sectional view of a plug and receptacle connector according to the second embodiment of the present invention.

The coupling nut 120 includes an annular recessed area 140 for receiving the compression spring 122. The spring 122 biases the coupling nut 132 rearwardly as depicted in FIG. 6 by forcing the spring retainer 124 rearwardly. The spring retainer 124 is retained by the retaining ring 126 which is retained in an annular groove in the coupling nut 132. A shoulder 158 on the plug shell 132 contacts an inwardly extending shoulder 133 on the sleeve 130. The shoulder 133 on the sleeve is sandwiched between the retaining ring 128 and the shoulder 158 such that movement of the plug shell 132 in either direction causes rotation of the sleeve 130. Extending inwardly from the recessed area are a plurality of keys 142 for restricting rotation of the plug shell 132 in a circumferential direction. A plurality of studs 144 extend inwardly from the coupling nut 120 and are equally circumferentially spaced. The plug shell 132 is retained in the coupling nut 120 by the first retaining ring 128 and the retaining ring 126 which fit into respective retaining grooves 150, 152 in the plug shell 132. The plug shell 132 also has keyways 154 which receive keys 142 of the coupling nut 120 when the plug shell 132 is retained within the coupling nut 120. The plug shell 132 is retained by the retaining rings 126, 128 as shown in FIGS. 5 and 6 which limit axial movement of the plug shell 132. The sleeve 130 is retained by a shoulder 158 and retaining ring 128 retained in groove 150 on the plug shell 132 in an axial direction but is free to rotate. The studs 144 in the coupling nut 120 are adjacent in an axial direction to the coupling nut ramps 160 (see FIG. 6) in sleeve 130.

The receptacle 110 has a plurality of studs 170 to be received by the receptacle ramps 172.

The rotating sleeve 130 interacts with studs 170 on the receptacle 110 and studs 144 on the coupling nut 120. The plug connector 102 includes the rotating sleeve 130, the coupling nut 120 with studs 144 and a spring 122. The coupling nut 120 also is fixed from rotation by keys 142 protruding into keyways 154 of the plug shell 132. The purpose of the keys 142 and keyways 154 is to prevent the rotation of the plug shell 132 when the coupling nut 120 studs 144 enter the respective ramps 160 of the sleeve 130. The studs 144 of the coupling nut 120 are forced by the spring 122 axially to make contact with an edge of the sleeve 130. This is the pre-charged sleeve 130 position and no axial motion of the sleeve 130 will occur until at some point, the coupling nut studs 144 will transfer contact to respective ramp surfaces 160 of the sleeve 130. The sleeve 130 is allowed to rotate freely about its axis coincident to the plug shell 132 and receptacle shell 112 axis.

The receptacle 110 has studs 170 which when plug connector 102 is mated to it will interact with complementary ramps 172 on the plug connector sleeve. The receptacle studs 170 needs to first be aligned with the receptacle stud ramps 172. Once the receptacle studs 170 are aligned with the ramps 172, the plug assembly 102 and the receptacle assembly 110 are pushed together into the locked, mated condition. These ramps 172 are angled with respect to the receptacle studs 170 to create a mechanical advantage to rotate the sleeve 130 while mating the plug connector 102. The rotation of the sleeve 130 will eventually reach a point where the coupling nut studs 144 enter the coupling nut ramp 160 of the sleeve 130. The coupling nut ramp 160 is biased to create a mechanical advantage to rotate the sleeve 130 about its axis. The energy of the spring 122 creates substantial torque on the sleeve 130. This torque transfers and assists the push force of the plug 102 into the receptacle 110. The sleeve 130 will continue to rotate until the plug shell 132 interacts with the receptacle shell 112 and the gap is eliminated as discussed below. The mechanical advantage is so great that when an opposing axial force is placed on the plug connector assembly 102 against the receptacle 110 connector, the positions of the plug assembly 102 and the receptacle assembly 110 are maintained.

Removal of the plug connector 102 from the mated locked position is accomplished by pulling the coupling nut 120 and only the coupling nut 120 axially away from the receptacle connector 110. This creates a reversal in the sleeve 130 rotation through the interaction of the coupling studs 144 interacting against the opposite surface of the ramps 160. The axial force on the coupling nut 120 is also compressing the spring 122 until the point the coupling nut studs 144 rest on the sleeve 130 in the dwell condition. Further pulling the coupling nut 120 continues to rotate the sleeve 130 and by the receptacle shell studs 170. The receptacle shell studs 170 pull against the opposite surface of the respective ramps 172 (as compared to when the plug assembly 102 and the receptacle assembly 110 are mated) of the sleeve 130 creating further rotation until the studs 170 exit the ramps. The plug connector sleeve 130, coupling nut 120 with studs 144 and the spring 122 are again in a pre-charged condition awaiting the next mating.

Figure 7:
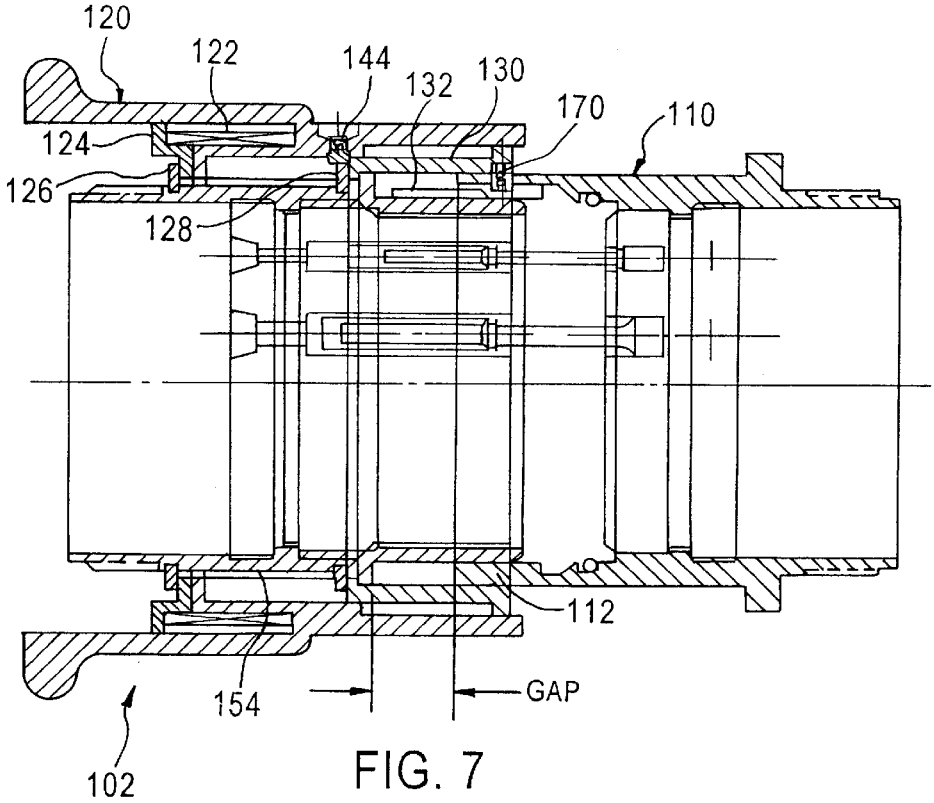
FIG. 7 is a view similar to FIG. 5 where the studs of a plug and receptacle connector are just contacting a sleeve with ramps and there is an initial gap between a front edge of the receptacle and a shoulder in the plug shell.

In FIG. 7, the plug connector 102 makes initial contact to the receptacle connector 110. The receptacle studs 170 just contact the respective ramps 172 of the sleeve 130. The receptacle studs 170 are aligned with ramps 172. The coupling nut 120 is in the pre-charged state.

Figure 8:
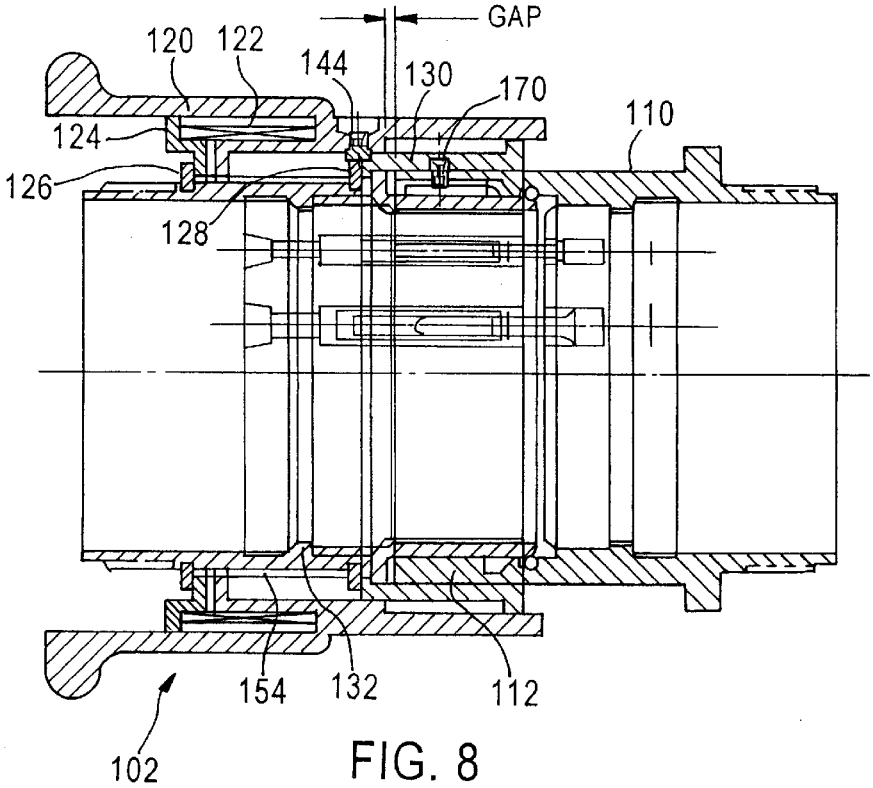
FIG. 8 is a view similar to FIG. 7 where the studs have engaged the sleeve and the gap has been reduced.

In FIG. 8, this is the point at which the plug connector sleeve 130 has rotated to the point where the coupling nut studs 144 begin to fall into their respective ramp 160. At this position, the coupling nut spring 122 force begins to contribute to the rotation of the sleeve 130. This action pulls the plug connector 102 into the receptacle connector 110 until the connectors are locked together.

Figure 9A:
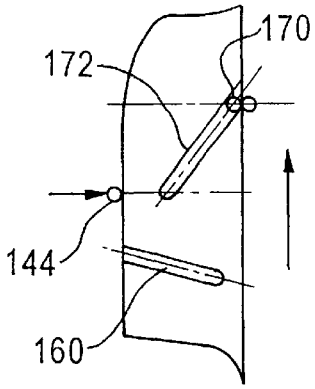
FIGS. 9A–9C are plan views of the relationship between the ramps in the sleeve and the studs.
Figure 9B:
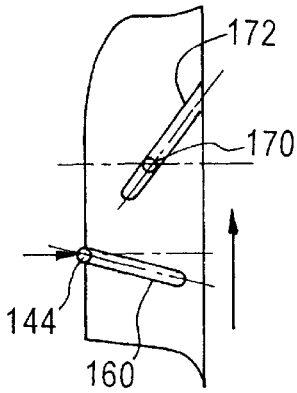
Figure 9C:
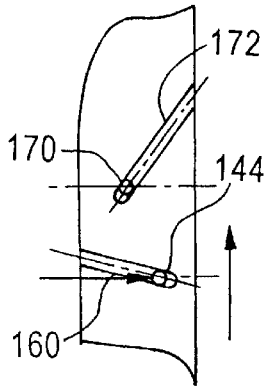
Figure 10:
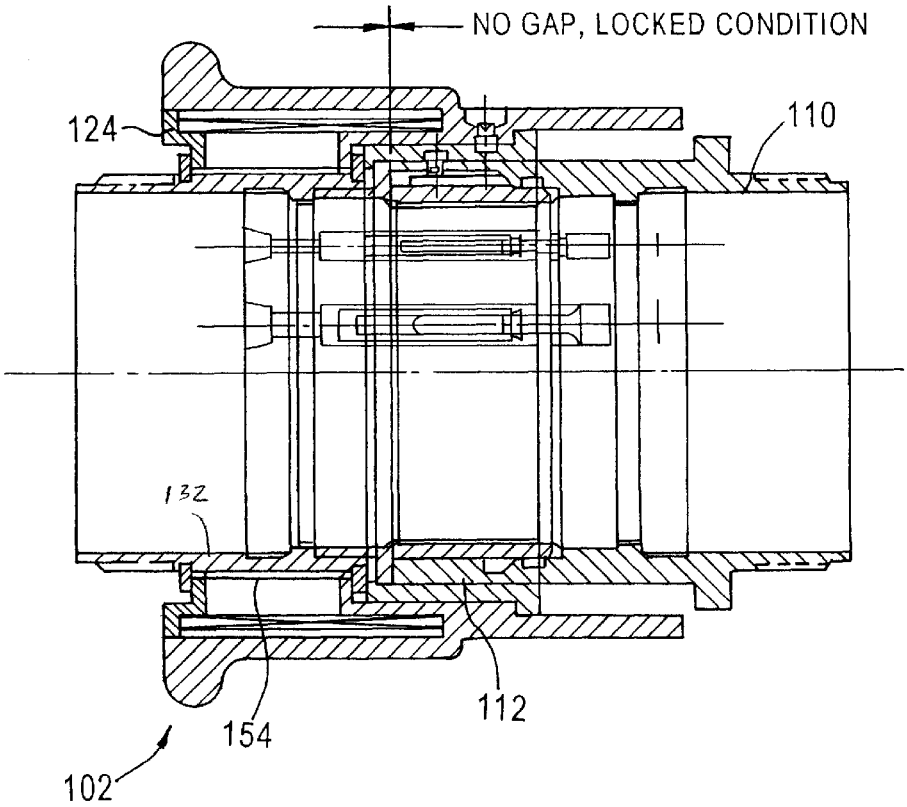
FIG. 10 is a view of the connector in a locked mated condition.

FIGS. 9A, 9B and 9C depict a plan view of the ramps 160, 172 of the sleeve 130 with respect to the coupling nut studs 144 and the receptacle shell studs 170 in progression relative to the positions shown in FIGS. 7, 8 and 10, respectively. These figures show how the respective ramp angles relate to each other.

The studs 144 are in a dwell, latched position as depicted in FIG. 9A and the receptacle studs 170 are in an initial condition where axial movement of the coupling nut 120 in a direction towards the receptacle assembly 110 causes the receptacle studs 170 to engage the receptacle ramps 172 causing the sleeve 130 to rotate. The coupling nut studs 144 remain stationary but rotation of the sleeve 130 eventually causes the studs 144 to enter the ramps 160 as depicted in FIG. 9B. Continued rotation causes the sleeve 130 to move to the locked mated condition depicted in FIG. 9C. Axial movement of the sleeve 130 stops when plug shell flange 29 contacts the receptacle front surface.

The receptacle ramp 172 angle is such that a low component force exists to rotate the sleeve 130. Also, there is a high component force exerted axially on the sleeve 130. The sleeve 130 ramp angles are such that a high component force to rotate the sleeve 130 exists. The relative angle of the coupling nut ramp 160 and the receptacle shell ramp 172 is close to perpendicular to each other, thus providing a near lock condition created by the force exerted by the coupling nut studs 144 by spring 122.

Figure 11:
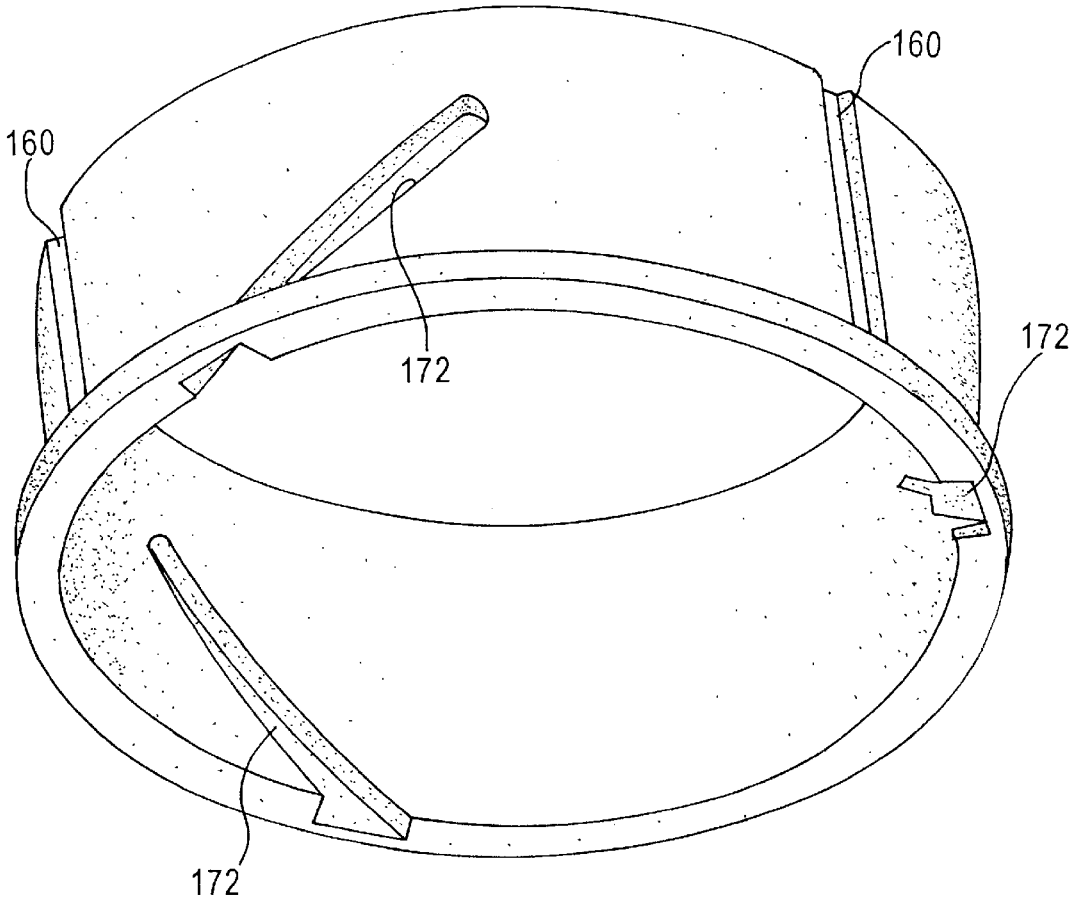
FIG. 11 is a perspective view of a sleeve including receptacle stud ramps according to the present invention.
Figure 12:
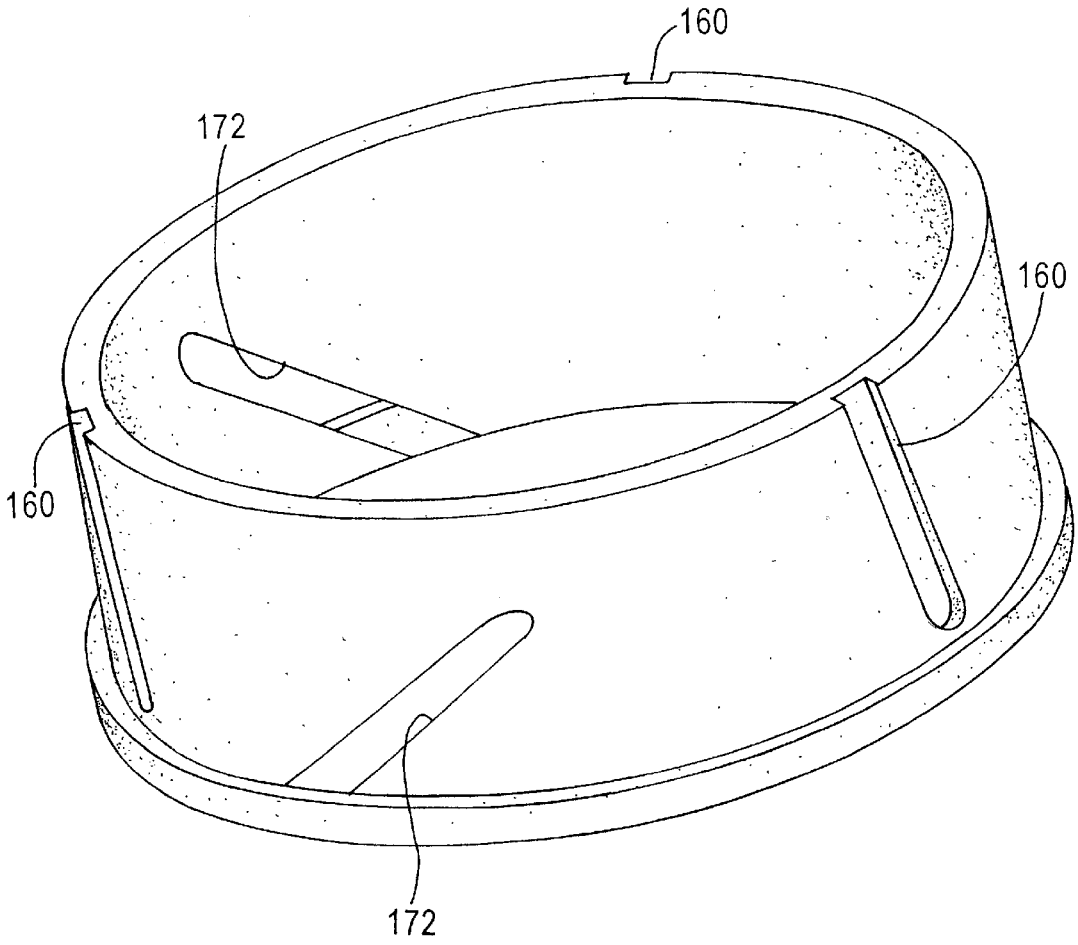
FIG. 12 is another perspective view similar to FIG. 11.

In FIG. 10, the connectors are shown in the fully mated, locked condition. The plug shell 132 is locked against the receptacle shell 112 eliminating movement between them. FIGS. 11 and 12 are additional perspective views of the sleeve 130.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electrical connector, comprising:

a receptacle assembly including a receptacle connector having a plurality of movable balls retained in a wall thereof;

a plug assembly including a plug shell having a shoulder and an annular groove, a coupling ring having a shoulder and a thrust surface, a spring associated with said coupling ring and biasing said coupling ring shoulder toward said plug shell shoulder;

wherein said receptacle assembly and said plug assembly have an unmated condition and a locked mated condition and said receptacle assembly and said plug assembly are brought into said locked mated condition when said receptacle assembly and said plug assembly are pushed together and said plurality of balls are thrust radially inwardly into said annular groove and retained there by the spring bias and thrust surface both during mating and after being brought into the locked mated condition.

2. The electrical connector of claim 1, wherein said movable balls extend radially inwardly and radially outwardly beyond an inner wall and an outer wall of said receptacle.

3. The electrical connector of claim 2, wherein said receptacle body has a plurality of transverse through holes and said movable balls are retained in said wall.

4. The electrical connector of claim 1, wherein the electrical connector has one or more electrical contacts.

5. The electrical connector of claim 1, further comprising a key on one of said receptacle assembly and said plug assembly and a keyway on the other one of said receptacle assembly and said plug assembly.

6. The electrical connector of claim 1, wherein the coupling ring has an angled thrust surface that is biased such that when the thrust surface is in contact with said balls said balls, are forced in a radially inward direction.

* * * * *